US008876107B2

(12) United States Patent
Suzuki et al.

(10) Patent No.: US 8,876,107 B2
(45) Date of Patent: Nov. 4, 2014

(54) SHEET STACKING DEVICE, IMAGE FORMING SYSTEM, AND SHEET STACKING METHOD

(71) Applicants: Junya Suzuki, Kanagawa (JP); Kiichiro Goto, Kanagawa (JP); Takashi Fukumoto, Kanagawa (JP); Yasuo Niikura, Kanagawa (JP); Shintaro Matsumoto, Kanagawa (JP); Satoru Takano, Kanagawa (JP); Hidetoshi Kojima, Kanagawa (JP); Kei Sasaki, Kanagawa (JP); Kazunori Konno, Kanagawa (JP); Yuuta Mori, Kanagawa (JP); Kohjiroh Haga, Kanagawa (JP); Takamasa Matsumoto, Kanagawa (JP); Ryo Takahashi, Kanagawa (JP); Youhei Niitsuma, Kanagawa (JP)

(72) Inventors: Junya Suzuki, Kanagawa (JP); Kiichiro Goto, Kanagawa (JP); Takashi Fukumoto, Kanagawa (JP); Yasuo Niikura, Kanagawa (JP); Shintaro Matsumoto, Kanagawa (JP); Satoru Takano, Kanagawa (JP); Hidetoshi Kojima, Kanagawa (JP); Kei Sasaki, Kanagawa (JP); Kazunori Konno, Kanagawa (JP); Yuuta Mori, Kanagawa (JP); Kohjiroh Haga, Kanagawa (JP); Takamasa Matsumoto, Kanagawa (JP); Ryo Takahashi, Kanagawa (JP); Youhei Niitsuma, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/096,111

(22) Filed: Dec. 4, 2013

(65) Prior Publication Data

US 2014/0159301 A1 Jun. 12, 2014

(30) Foreign Application Priority Data

Dec. 10, 2012 (JP) ..... 2012-269750

(51) Int. Cl.
*B65H 31/26* (2006.01)
*B65H 31/34* (2006.01)

(52) U.S. Cl.
CPC ..... *B65H 31/34* (2013.01)
USPC ..... 271/220; 271/221

(58) Field of Classification Search
USPC ..... 271/220, 221, 207
See application file for complete search history.

(56) References Cited

U.S. PATENT DOCUMENTS

| | | | | |
|---|---|---|---|---|
| 8,172,214 | B2 * | 5/2012 | Kubota et al. | 270/58.1 |
| 2003/0006543 | A1 | 1/2003 | Tamura et al. | |
| 2003/0234487 | A1 | 12/2003 | Tamura et al. | |
| 2005/0082747 | A1 | 4/2005 | Tamura et al. | |
| 2006/0022394 | A1 | 2/2006 | Tamura et al. | |
| 2006/0261544 | A1 | 11/2006 | Tamura et al. | |
| 2007/0176357 | A1 * | 8/2007 | Horio et al. | 271/220 |
| 2010/0150636 | A1 * | 6/2010 | Kubota et al. | 399/407 |

FOREIGN PATENT DOCUMENTS

| | | |
|---|---|---|
| JP | 2003-002513 | 1/2003 |
| JP | 2004-284786 | 10/2004 |
| JP | 2006-095864 | 4/2006 |

* cited by examiner

*Primary Examiner* — Michael McCullough
*Assistant Examiner* — Howard Sanders
(74) *Attorney, Agent, or Firm* — Harness, Dickey & Pierce, P.L.C.

(57) ABSTRACT

A sheet stacking device includes: a stacking unit that stacks thereon a sheet discharged in a sheet discharging direction; a conveying unit that performs a moving-back operation of conveying the stacked sheet in a direction opposite to the sheet discharging direction; a pressing unit that performs a pressing operation of pressing the conveyed sheet; and a driving unit that drives the conveying unit and the pressing unit by a same driving source.

8 Claims, 15 Drawing Sheets

SHEET STACKING DEVICE, IMAGE FORMING SYSTEM, AND SHEET STACKING METHOD

CROSS-REFERENCE TO RELATED APPLICATIONS

The present application claims priority to and incorporates by reference the entire contents of Japanese Patent Application No. 2012-269750 filed in Japan on Dec. 10, 2012.

BACKGROUND OF THE INVENTION

1. Field of the Invention

The present invention relates to a sheet stacking device, an image forming system, and a sheet stacking method, and more particularly concerns a sheet stacking device that aligns and stacks sheets of a recording medium such as paper, recording paper, transfer paper, or transparency (hereinafter simply referred to as "sheets") delivered into the sheet stacking device when the sheets are discharged, an image forming system including the sheet stacking device and an image forming apparatus such as a copier, a printer, a facsimile, or a digital multifunction peripheral, and a sheet stacking method performed by the sheet stacking device.

2. Description of the Related Art

Conventionally, sheet processing apparatuses that perform various processing, e.g., postprocessing such as alignment, stapling, folding, and bookbinding, on sheets discharged from an image forming apparatus are widely known and used. Hereinafter, such a sheet processing apparatus that performs post processing is referred to as a sheet post processing apparatus. In recent years, variety of sheets desired to be processed by this type of sheet post processing apparatus has become noticeably wide. In particular, it has become more common to perform printing using a color image forming apparatus on a sheet of coated paper (hereinafter, "coated paper") that produces a visually-superior image for a brochure, a leaflet, or the like. Coated paper generally has the following properties:

1) high surface smoothness;
2) high inter-sheet clinging force; and
3) low stiffness (Clark method).

These properties can make coated paper less favorable in terms of sheet stackability.

A technique utilizing a return roller for preventing such unfavorable stacking and stacking discharged sheets at a normal position is already known.

Meanwhile, an apparatus that utilizes a pressing member for preventing sheets from being misaligned on a sheet discharge tray is also already known. As an example of an apparatus that uses such a pressing member, a technique disclosed in Japanese Laid-open Patent Application No. 2004-284786 is known.

According to this technique, a sheet stacking device including an output tray, onto which image-formed sheets are to be discharged and stacked, and a pressing member that presses a trailing end portion in a direction, in which the sheets are discharged onto the output tray, is configured as follows. The output tray is movable a preset amount in a direction perpendicular to the sheet discharging direction to perform offset output. The pressing member is moved in synchronization with an offset operation of the output tray.

The conventionally-employed return roller can move back a sheet to a normal position as described above; however, the return roller cannot prevent a phenomenon that a subsequent sheet electrostatically clings to a preceding sheet and pushes out the preceding sheet. Furthermore, when a sheet discharge tray is shifted for offset sorting, an aligned state of the sheets in the sheet discharge tray cannot be maintained with the return roller.

To maintain the aligned state of the sheets, a combination of the pressing member disclosed in Japanese Laid-open Patent Application No. 2004-284786 and the return roller can be employed. The combination of the return roller and the pressing member allows, even when the sheet discharge tray is shifted, holding sheets at the normal position by moving back the sheets to the normal position with the return roller and causing the pressing member to hold the sheets at the position.

However, arranging the return roller and the pressing member in the sheet discharging unit requires space for accommodating them and space for mounting drive mechanisms that drive the return roller and the pressing member, respectively. When the sheet discharging unit is required to have such space, it naturally follows that the sheet discharging unit is increased in size.

Under the circumstances, there is a need for a technique for preventing a sheet from being pushed out by another sheet or misaligned due to electrostatic inter-sheet clinging using a compact device.

SUMMARY OF THE INVENTION

It is an object of the present invention to at least partially solve the problems in the conventional technology.

A sheet stacking device includes: a stacking unit that stacks thereon a sheet discharged in a sheet discharging direction; a conveying unit that performs a moving-back operation of conveying the stacked sheet in a direction opposite to the sheet discharging direction; a pressing unit that performs a pressing operation of pressing the conveyed sheet; and a driving unit that drives the conveying unit and the pressing unit by a same driving source.

An image forming system includes the sheet stacking device as described above.

A sheet stacking method includes: stacking a sheet discharged in a sheet discharging direction on a stacking unit; performing, by a conveying unit, a moving-back operation of conveying the stacked sheet in a direction opposite to the sheet discharging direction; and performing, by a pressing unit, a pressing operation of pressing the conveyed sheet. The conveying unit and the pressing unit are driven by a same driving source. Switching between operation of the conveying unit and operation of the pressing unit is performed in response to a rotating direction of the driving source. After a preceding sheet is discharged and the moving-back operation is completed, the pressing operation is started. The pressing unit withdraws from a pressing position before a trailing end of a subsequent sheet is discharged.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

According to an aspect of the present invention, a return roller and a pressing member are driven by a single driving source. The pressing member presses a trailing end of a discharged sheet in an ideal state, in which the discharged sheet has been moved back by the return roller.

A preferred embodiment of the present invention is described below with reference to the accompanying drawings via comparison with a configuration of a conventionally-employed sheet post processing apparatus, on which the embodiment is based.

An embodiment of the present invention is described below with reference to the accompanying drawings.

Figure 1:
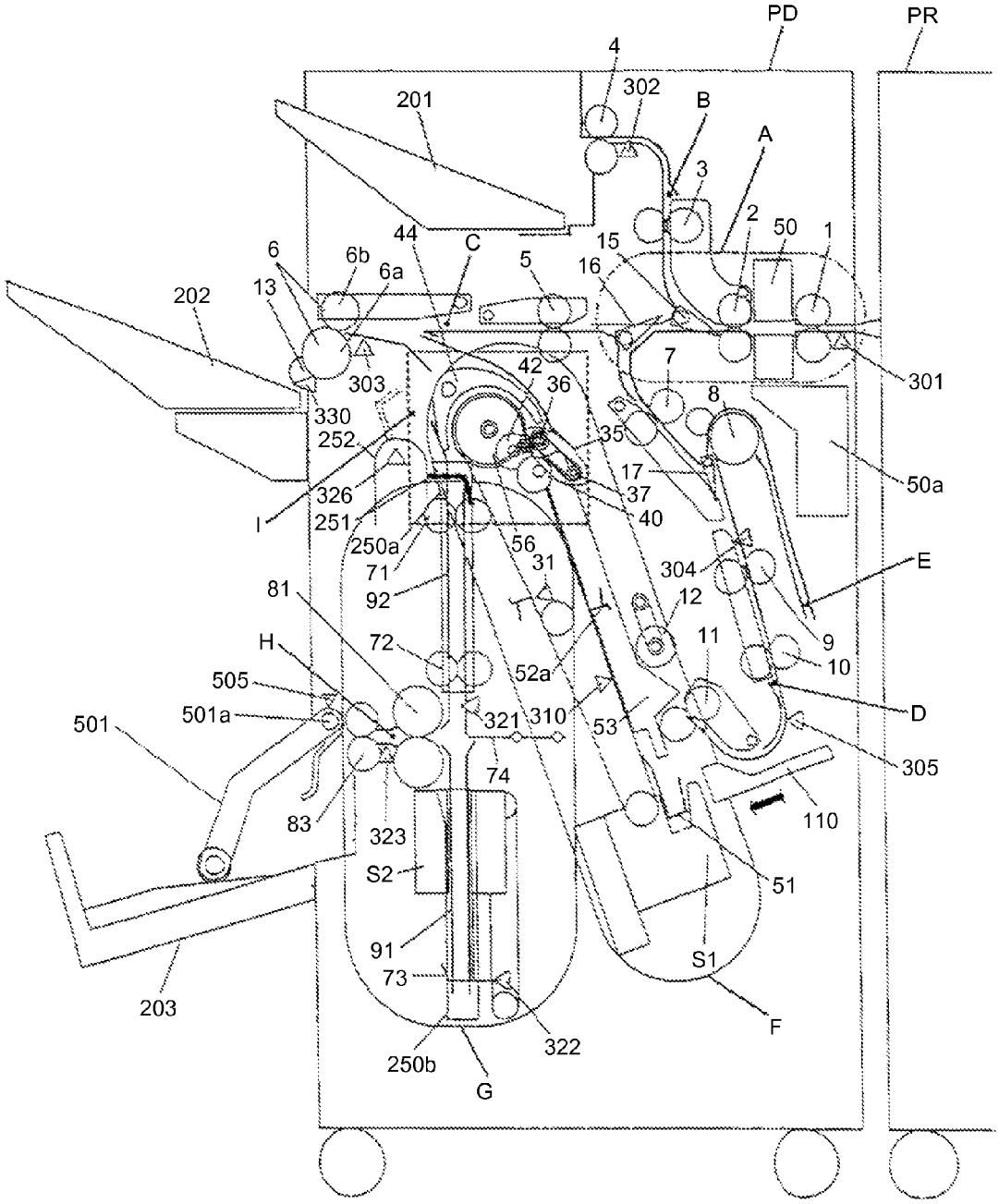
FIG. 1 is a system configuration diagram illustrating a system including an image forming apparatus and a sheet post processing apparatus that includes a sheet stacking device according to an embodiment of the present invention.

FIG. 1 is a system configuration diagram of an image forming system including an image forming apparatus PR and a sheet post processing apparatus PD corresponding to a sheet processing apparatus according to the embodiment.

Referring to FIG. 1, the image forming apparatus PR includes an image processing circuit, an optical writing device, a developing device, a transfer device, and a fixing device. The image forming apparatus PR delivers a sheet, on which a toner image is fixed, to the sheet post processing apparatus PD. The sheet post processing apparatus PD performs postprocessing as desired on the sheet. An image processing device converts image data input thereto into printable image data (image signals). The optical writing device performs optical writing on a photosensitive element based on the image signals output from the image processing circuit, thereby forming a latent image on the photosensitive element. The developing device develops the latent image into a toner image. The transfer device transfers the toner image developed by the developing device onto a media sheet (hereinafter, "sheet"). The fixing device fixes the transferred toner image onto the sheet.

In the present embodiment, the image forming apparatus PR is an electrophotographic image forming apparatus as described above, but not limited thereto. Any known image forming apparatus, e.g., of an inkjet type or a thermal transfer type, can be used as the image forming apparatus PR. In the embodiment, the image processing circuit, the optical writing device, the developing device, the transfer device, and the fixing device make up an image forming unit.

The sheet post processing apparatus PD is attached to a side of the image forming apparatus PR. A sheet discharged from the image forming apparatus PR is guided into the sheet post processing apparatus PD. The sheet post processing apparatus PD includes a conveying path A, a conveying path B, a conveying path C, a conveying path D, and a conveying path H. The sheet is conveyed to the conveying path A that includes a postprocessing unit (in the present embodiment, a punch unit 50 that is a punching unit) that performs postprocessing on a single sheet.

The conveying path B is a conveying path that extends from the conveying path A and leads to an upper tray 201. The conveying path C is a conveying path that leads to a shift tray 202. The conveying path D is a conveying path that leads to a processing tray F (hereinafter, also referred to as "side-stitching tray") where alignment, staple binding, and the like are performed. The conveying paths are configured such that a sheet conveyed to the conveying path A is then directed to one of the conveying paths B, C, and D by a bifurcating claw 15 and a bifurcating claw 16.

The sheet post processing apparatus can perform various sheet processing, such as hole punching (using the punch unit 50), sheet alignment and side stitching (using jogger fences 53 and a side-stitching stapler S1), sheet alignment and saddle stitching (using a saddle-stitching upper jogger fence 250*a*, a saddle-stitching lower jogger fence 250*b*, and a saddle-stitching stapler S2), sheet offset sorting (using the shift tray 202), and center folding (using a folding plate 74 and folding rollers 81). The conveying path A and one of the conveying paths B, C, and D extending from the conveying path A are selected depending on processing to be performed. The conveying path D includes a sheet holding unit E. The side-stitching tray F, a saddle-stitching/center-folding tray G, and the sheet-discharging conveying path H are arranged downstream of the conveying path D.

The conveying path A is upstream of each of the conveying path B, the conveying path C, and the conveying path D. An entry sensor 301 that detects a sheet received from the image forming apparatus PR is arranged on the conveying path A. Entry rollers 1, the punch unit 50, a punch waste hopper 50*a*, conveying rollers 2, and the first and second separating claws 15 and 16 are arranged in this order along the conveying path A downstream of the entry sensor 301. The first and second bifurcating claws 15 and 16 are held at orientations (initial state) illustrated in FIG. 1 by springs (not shown). When a first solenoid (not shown) and a second solenoid (not shown) are turned on, the bifurcating claw 15 and the bifurcating claw 16 are driven, respectively. A sheet is directed to a desired one of the conveying path B, C, and D by changing a combination of orientations of the first and second bifurcating claws 15 and 16 that depends on on/off of each of the first and second solenoids.

When the sheet is to be directed to the conveying path B, the state illustrated in FIG. 1 is maintained, or, more specifically, the first solenoid is maintained in the off state (the first bifurcating claw 15 is oriented downward in its initial state). In this state, the sheet is caused to pass between conveying rollers 3 and then between upper sheet discharging rollers 4 and discharged onto the upper tray 201.

When the sheet to be directed to the conveying path C, the first and second solenoids are turned on (the second bifurcating claw 16 is oriented upward in its initial state) from the state illustrated in FIG. 1 to put the bifurcating claw 15 and the bifurcating claw 16 in an upwardly pivoted state and a downwardly pivoted state, respectively. In this state, the sheet is conveyed between conveying rollers 5, then between pairs of sheet discharging rollers 6 (6*a* and 6*b*), and through a sheet discharging port 6*c* (see FIG. 13) toward the shift tray 202. In this case, sheet offset sorting is performed. Sheet offset sorting is performed using the shift tray 202, a shift mechanism (not shown) that causes the shift tray 202 to reciprocate in a direction perpendicular to the sheet conveying direction, and a shift-tray elevating mechanism that moves up or down the shift tray 202. The shift mechanism includes the shift sheet discharging rollers 6 (6*a* and 6*b*), a return roller 13, and a sheet-level surface sensor 330.

When the sheet is to be directed to the conveying path D, the first solenoid that drives the first bifurcating claw 15 is turned on and the second solenoid that drives the second bifurcating claw 16 is turned off, thereby putting the first and second bifurcating claws 15 and 16 in the upwardly pivoted state. In this state, the sheet is delivered between the conveying rollers 2 and then between conveying rollers 7 toward the conveying path D. The sheet delivered to the conveying path D is delivered to the side-stitching tray F. Sheets aligned and stapled on the side-stitching tray F are directed by a guide member 44 to one of the conveying path C along which the sheets are to be conveyed to the shift tray 202 and the saddle-stitching/center-folding tray (hereinafter, also referred to as "saddle stitching tray") G where the sheets undergo folding and the like. When a sheet bundle PB is to be delivered to the shift tray 202, the sheet bundle PB is discharged through the pairs of sheet delivery rollers 6 onto the shift tray 202. The sheet bundle PB delivered to the saddle-stitching tray G is folded and stapled on the saddle-stitching tray G and conveyed along the sheet-discharging conveying path H to be discharged through lower sheet discharging rollers 83 onto a lower tray 203.

A bifurcating claw 17 is arranged on the conveying path D and held in a state illustrated in FIG. 1 by a low-load spring (not shown). After a trailing end of the sheet conveyed by the conveying rollers 7 has passed by the bifurcating claw 17, at least conveying rollers 9 of the conveying rollers 9, conveying rollers 10, and sheet-stapling-discharging rollers 11 are rotated in reverse. By rotating the rollers in this manner, the sheet is conveyed backward along a turn guide 8. Thus, this configuration allows delivering the sheet to the sheet holding unit E in a trailing-end-first manner and temporarily holding (pre-stacking) the sheet so that the sheet can be conveyed together with a next sheet that is overlaid thereon. It becomes possible to convey, at a time, two or more sheets overlaid on one another by repeating this operation. A pre-stack sensor 304 is used to set timing for backward conveyance of the sheet to perform pre-stacking.

When sheet alignment and side stitching are to be performed on a sheet delivered to the conveying path D, the sheet is delivered by the sheet-stapling-discharging rollers 11 to the side-stitching tray F. Sheets delivered one sheet by one sheet are stacked on the side-stitching tray F. Each time a sheet is stacked in this operation, sheets are aligned in a longitudinal direction (the sheet conveying direction) by a tapping roller 12 against a trailing-end reference fence 51 and aligned in a lateral direction (the direction perpendicular to the sheet conveying direction; also referred to as the "sheet width direction") against the jogger fences 53. The side-stitching stapler S1, which is a stapling unit, is driven to perform stapling in response to a stapling signal fed from a central processing unit (CPU) 101, which will be described later, in an interval between jobs, i.e., an interval between the last sheet of the sheet bundle PB and the first sheet of a subsequent sheet bundle. Immediately after the stapling, the stapled sheet bundle PB is conveyed by an ejecting belt 52 (see FIG. 2), from which ejecting tabs 52*a* project, to the pairs of (shift) sheet discharging rollers 6. The sheet discharging rollers 6 discharge the sheet bundle PB onto the shift tray 202 that is at a receiving position.

Figure 2:
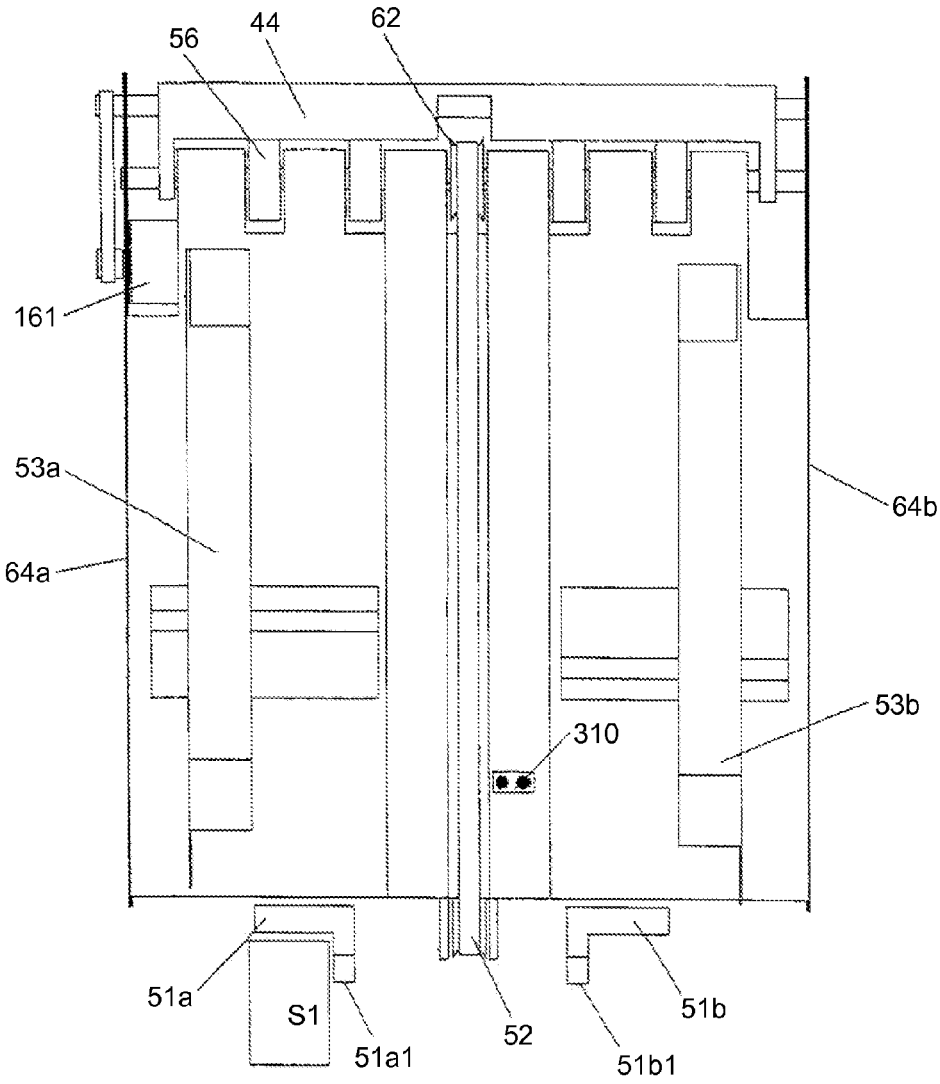
FIG. 2 is a schematic configuration diagram of a side-stitching tray illustrated in FIG. 1 as viewed from a sheet-stacking surface side of the tray.
Figure 4:
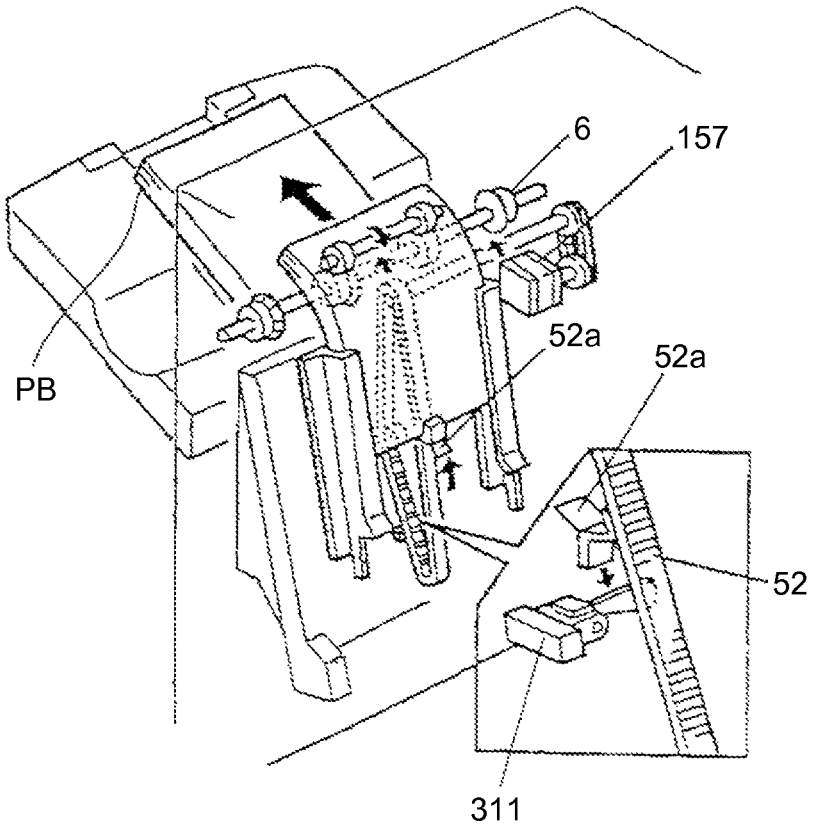
FIG. 4 is a perspective view illustrating an operation of an ejecting belt illustrated in FIG. 1.

As illustrated in FIGS. 2 and 4, the ejecting belt 52 is at a center of aligned sheets in the sheet width direction, laid between and around pulleys 62 in a tensioned manner, and driven by an ejecting-belt driving motor 157. A plurality of ejecting rollers 56 are arranged to be symmetric with respect to the ejecting belt 52 and rotatable about a drive shaft to function as driven rollers.

A home position (HP) of the ejecting tabs 52*a* is detected by an ejecting-belt HP sensor 311. The ejecting-belt HP sensor 311 is switched on and off by the ejecting tabs 52*a* provided on the ejecting belt 52. The ejecting tabs 52*a* are arranged on an outer circumferential surface of the ejecting belt 52 at positions where the ejecting tabs 52*a* face each other, and alternately convey the sheet bundle PB held in the side-stitching tray F. It is also possible to rotate the ejecting belt 52 in reverse as required, thereby aligning leading ends of sheets of the sheet bundle PB held in the side-stitching tray F in the conveying direction with one of the ejecting tabs 52*a* that is on standby to move the sheet bundle PB and a back surface of the other one of the ejecting tabs 52*a*.

Reference numeral 110 in FIG. 1 denotes a trailing-end holding lever. The trailing-end holding lever 110 is arranged at a bottom end portion of the trailing-end reference fence 51 so that the trailing-end holding lever 110 can retain a trailing end of the sheet bundle PB held in the trailing-end reference fence 51. The trailing-end holding lever 110 reciprocates substantially perpendicularly to the side-stitching tray F. A sheet P discharged onto the side-stitching tray F is aligned by the tapping roller 12 in the longitudinal direction (sheet conveying direction) on a per-sheet basis. However, in a case where a trailing end of a sheet in the side-stitching tray F is curled or has low stiffness, the sheet is likely to be buckled under its own weight and bulge at the trailing end. Moreover, the greater the number of stacked sheets, the smaller space is left in the trailing-end reference fence 51 to hold a next sheet therein, resulting in less favorable alignment in the longitudinal direction. A trailing-end holding mechanism is employed to reduce bulge of a sheet trailing end PT to facilitate entry of the sheet P to the trailing-end reference fence 51. In this mechanism, an element that directly retains the sheet P or the sheet bundle PB is the trailing-end holding lever 110.

In FIG. 1, reference numerals 302, 303, 304, 305, and 310 denote sheet detection sensors for detecting whether or not a sheet has passed by a position where the detection sensor is provided or presence/absence of a sheet.

FIG. 2 is a schematic configuration diagram of the side-stitching tray F as viewed from a sheet-stacking surface side of the tray or, in other words, as viewed from the right side in FIG. 1. Referring to FIG. 2, a sheet received from the image forming apparatus PR which is upstream of the sheet post processing apparatus PD is aligned against jogger fences 53*a* and 53*b* in the sheet width direction, and aligned in the longitudinal direction by being abutted on trailing-end reference fences 51*a* and 51*b* (indicated by reference numeral 51 in FIG. 1). The trailing-end reference fences 51*a* and 51*b* include stack surfaces 51*a*1 and 51*b*1, respectively, that support the sheet trailing end PT in such a two-point-support manner that the sheet trailing end PT abuts on inner sides of the stack surfaces 51*a*1 and 51*b*1 to be held thereby. After completion of the alignment, the side-stitching stapler S1 performs stapling. As can be seen from the perspective view of FIG. 4 that illustrates an operation of the ejecting belt 52, the ejecting belt 52 is rotated counterclockwise by the ejecting-belt driving motor 157. Accordingly, the trailing-end reference fences 51*a* and 51*b* push up the stapled sheet bundle PB to a predetermined position. The stapled sheet bundle PB is lifted up and ejected from the side-stitching tray F by the ejecting tabs 52*a* attached to the ejecting belt 52. Reference numerals 64*a* and 64*b* denote a front side plate and a back side plate, respectively. An operation similar to this operation can be performed on a not-stapled sheet bundle on which stapling is not performed after the alignment.

Figure 3:
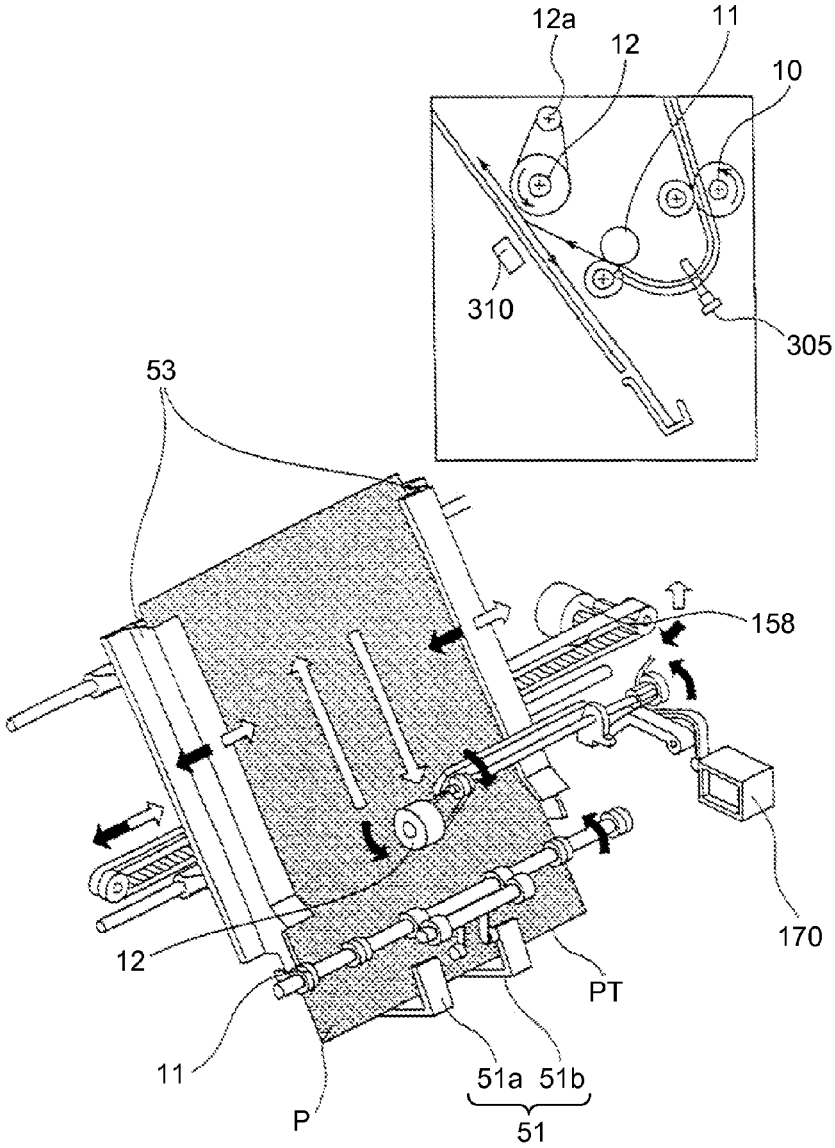
FIG. 3 is a perspective view illustrating a schematic configuration of the side-stitching tray and mechanisms relevant thereto.

FIG. 3 is a perspective view illustrating a schematic configuration of the side-stitching tray F and mechanisms relevant thereto. As illustrated in FIG. 3, the sheet(s) P delivered by the sheet-stapling-discharging rollers 11 to the side-stitching tray F is stacked one sheet by one sheet on the side-stapling tray F. At this time, when the number of the sheets P discharged onto the side-stitching tray F is one, sheet alignment is performed on a per-sheet basis in the longitudinal direction (the sheet conveying direction) between the tapping roller 12 and the trailing-end reference fence 51. Subsequently, the jogger fences 53*a* and 53*b* perform sheet alignment in the sheet width direction (sheet width direction perpendicular to the sheet conveying direction). The tapping roller 12 is driven to swing on a pivot support 12*a* by a tapping solenoid (SOL) 170. The tapping roller 12 intermittently acts on the sheet delivered onto the side-stitching tray F, causing the sheet trailing end PT to abut on the trailing-end reference fence 51. Meanwhile, the tapping roller 12 rotates counterclockwise in FIG. 3. As illustrated in FIGS. 2 and 3, the pair of jogger fences 53 (53*a* and 53*b*) is arranged at the front and rear. The pair of jogger fences 53 is driven by a reversible jogger motor 158 via a timing belt to reciprocate toward and away from each other in the sheet width direction.

Referring back to FIG. 1, a sheet-bundle steering mechanism is arranged downstream of the side-stitching tray F in the sheet conveying direction. The sheet-bundle steering mechanism includes a turn conveying path for conveying the sheet bundle PB from the side-stitching tray F to the saddle-stitching tray G, a conveying path for conveying the sheet bundle PB from the side-stitching tray F to the shift tray 202, and a conveying unit that conveys the sheet bundle PB. The conveying paths and the conveying unit are made up of a conveying mechanism 35 that applies a conveying force to the sheet bundle PB, the ejecting rollers 56 that cause the sheet bundle PB to make a turn, and the guide member 44 that guides the sheet bundle PB so as to make the turn.

Configurations of these elements are described in detail below. The conveying mechanism 35 includes a drive shaft 37 and a roller 36, to which a driving force of the drive shaft 37 is transmitted via a timing belt. The roller 36 and the drive shaft 37 are connected and supported by an arm in such a manner that the roller 36 can pivot about the drive shaft 37 serving as a pivot support. The roller 36 of the conveying mechanism 35 is driven to pivot via a cam 40 that is rotated about a rotary shaft by a motor (not shown). The conveying mechanism 35 includes a driven roller 42 at a position where the driven roller 42 faces the roller 36. The conveying mechanism 35 applies a conveying force to the sheet bundle PB by pinching the sheet bundle PB between the driven roller 42 and the roller 36 and pressing the sheet bundle PB with an elastic member.

The turn conveying path, along which the sheet bundle PB is turned from the side-stitching tray F to the saddle-stitching tray G, is provided between the ejecting rollers 56 and an inner surface of the guide member 44 on the side where the guide member 44 faces the ejecting rollers 56. The guide member 44 is driven to pivot about a pivot support on a driving force transmitted to the guide member 44 from a bundle-route-switching driving motor 161 (see FIG. 2). When conveying the sheet bundle PB from the side-stitching tray F to the shift tray 202, the guide member 44 pivots clockwise in FIG. 1 about the pivot support, causing a clearance between an outer surface (the surface on the side where the guide member 44 does not face the ejecting rollers 56) of the guide member 44 and a guide plate on the outside of the outer face to function as the conveying path. When conveying the sheet bundle PB from the side-stitching tray F to the saddle-stitching tray G, the ejecting tab 52*a* pushes up the trailing end of the sheet bundle PB aligned on the side-stitching tray F. The roller 36 of the conveying mechanism 35 and the driven roller 42 facing the roller 36 pinch the sheet bundle PB therebetween to apply a conveying force to the sheet bundle PB. Before pinching the sheet bundle PB, the roller 36 of the conveying mechanism 35 is on standby at a position where the roller 36 does not contact a leading end of the sheet bundle PB. Then, after the leading end of the sheet bundle PB has passed by the roller 36 of the conveying mechanism 35, the roller 36 is brought into contact with the sheet surface to apply the conveying force to the sheet bundle PB. In this conveyance, the guide member 44 and the ejecting rollers 56 form a guide of the turn conveying path and convey the sheet bundle PB downstream to the saddle-stitching tray G.

As illustrated in FIG. 1, the saddle-stitching tray G is arranged downstream from the sheet-bundle steering mechanism that includes the conveying mechanism 35, the guide member 44, and the ejecting rollers 56. The saddle-stitching tray G is arranged downstream of the sheet-bundle steering mechanism in a substantially upright position. The saddle-stitching tray G includes a center folding mechanism at a center portion of the saddle-stitching tray G, and an upper bundle-conveyance guide plate 92 and a lower bundle-conveyance guide plate 91 above and below the center folding mechanism, respectively.

Upper bundle conveying rollers 71 and lower bundle conveying rollers 72 are arranged in an upper portion and a lower portion of the upper bundle-conveyance guide plate 92, respectively. The saddle-stitching upper jogger fences 250*a* are arranged along side surfaces of the upper bundle-conveyance guide plate 92 in a manner to straddle the rollers 71 and 72. Similarly, saddle-stitching lower jogger fences 250*b* are arranged along side surfaces of the lower bundle-conveyance guide plate 91. The saddle-stitching stapler S2 is arranged at a position where the saddle-stitching lower jogger fences 250*b* are provided. The saddle-stitching upper jogger fences 250*a* and the saddle-stitching lower jogger fences 250*b* are driven by a drive mechanism (not shown) and perform alignment in the direction (sheet width direction) perpendicular to the sheet conveying direction. The saddle-stitching stapler S2 includes two stapler units that are spaced from each other a predetermined distance in the sheet width direction. Each stapler unit includes a pair of a clincher unit and a driving unit.

A movable trailing-end reference fence 73 extends across the lower bundle-conveyance guide plate 91. A moving mechanism including a timing belt and a drive mechanism for the timing belt allows the movable trailing-end reference fence 73 to move in the sheet conveying direction (i.e., the vertical direction in FIG. 1). As illustrated in FIG. 1, the drive mechanism includes a drive pulley and a driven pulley between and around which the timing belt is laid, and a stepping motor that drives the drive pulley. A trailing-end tapping member 251 and a drive mechanism for the trailing-end tapping member 251 are arranged at a top end of the upper bundle-conveyance guide plate 92. The trailing-end tapping member 251 is driven by a drive mechanism (not shown) via a timing belt 252 to move in a reciprocating manner in a direction away from the sheet-bundle steering mechanism and a direction in which the trailing-end tapping member 251 presses the trailing end (which is the trailing end of the sheet bundle PB as being conveyed into the saddle-stitching tray G) of the sheet bundle PB.

The center folding mechanism positioned at substantially center of the saddle-stitching tray G includes the folding plate 74, the folding rollers 81, and the conveying path H, along which the folded sheet bundle PB is conveyed. Referring to FIG. 1, an HP sensor 326 detects a home position of the trailing-end tapping member 251; a crease passage sensor 323 detects a center-folded sheet; a bundle detection sensor 321 detects arrival of the sheet bundle PB at a center-folding position; a movable-trailing-end-reference-fence HP sensor 322 detects a home position of the movable trailing-end reference fence 73.

In the present embodiment, a detection lever 501 for detecting a stack height of the center-folded sheet bundle PB is arranged on the lower tray 203 to be pivotable on a fulcrum 501*a*. A sheet level sensor 505 detects an angle of the detection lever 501. Ascending/descending of the lower tray 203 and tray-full detection of the same are performed based on the detected angle.

Figure 5:
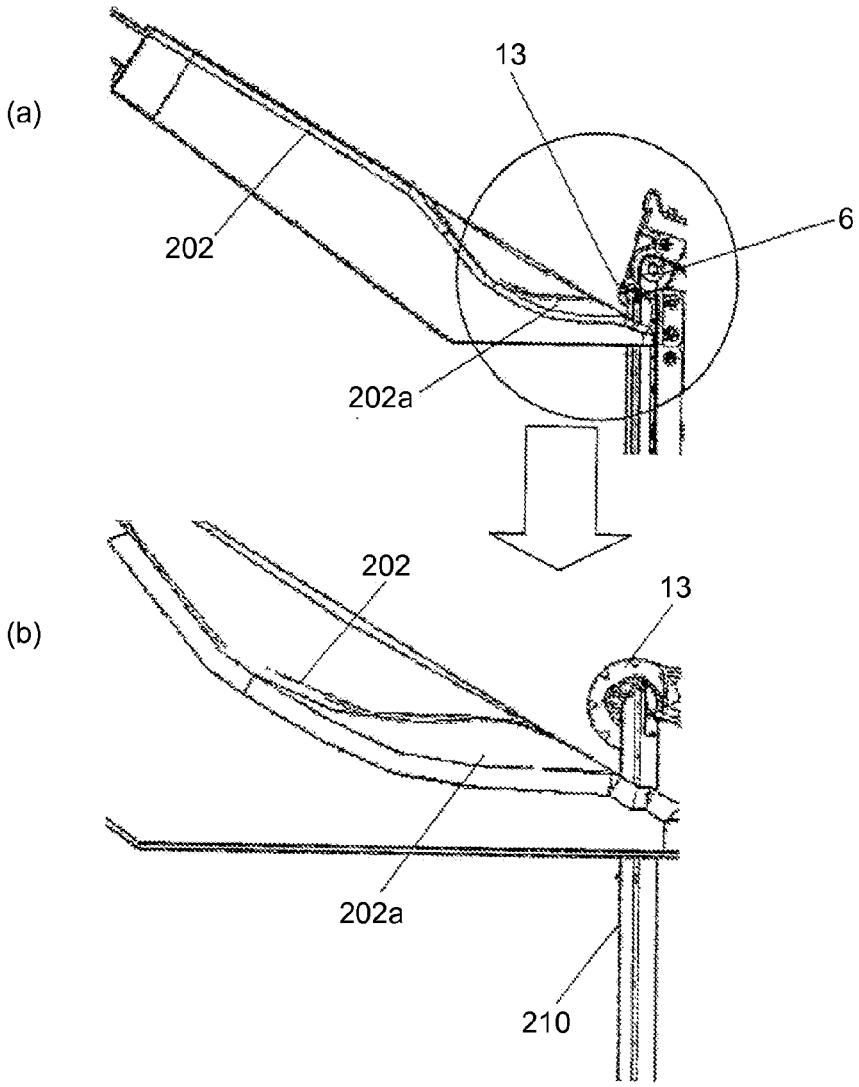
FIG. 5 is a front view of a relevant portion of a shift tray illustrated in FIG. 1 on standby.

FIG. 5 is a front view of a relevant portion of a sheet discharging unit for the shift tray 202. FIG. 5(*a*) is a diagram illustrating the sheet discharging unit on standby for sheet discharging. FIG. 5(*b*) is an enlarged view of the circled portion of FIG. 5(*a*). As described above, the sheet P is conveyed through the pairs of sheet discharging rollers 6 (6*a* and 6*b*) to the shift tray 202 where offset sorting of the sheer, P is performed. Sorting of the sheet P is performed by the pairs of shift, discharging rollers 6 (6*a* and 6*b*), the return roller 13, the shift tray 202, the shift mechanism, and the shift-tray elevating mechanism as described above.

Figure 6:
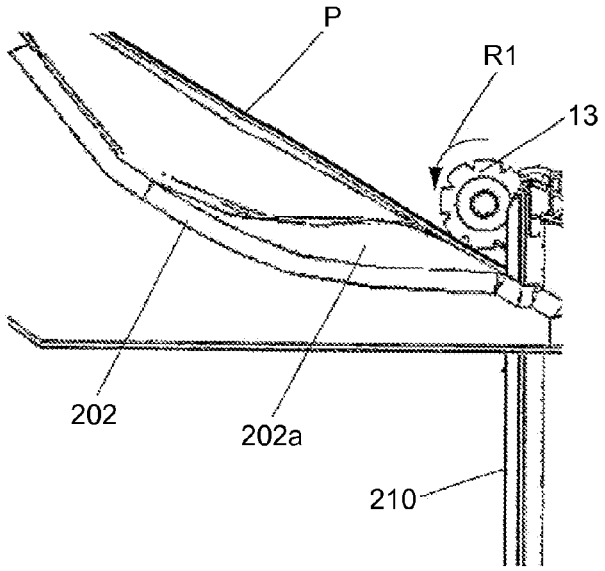
FIG. 6 is an explanatory diagram of an alignment operation in a conveying direction on the shift tray.

FIG. 6 is an explanatory diagram of an alignment operation in the conveying direction. The alignment operation is performed in the following manner after the sheet P is discharged. The return roller 13 rotating in the direction (direction indicated by arrow R1) that brings the sheet P back toward an end fence 210 comes into contact with the sheet P, thereby actively moving the sheet P back toward the end fence 210. The return roller 13 is driven by a return-roller driving motor, which is not illustrated in FIG. 6. A driving force generated by the return-roller driving motor is transmitted to the return roller 13 via a timing belt.

Figure 7:
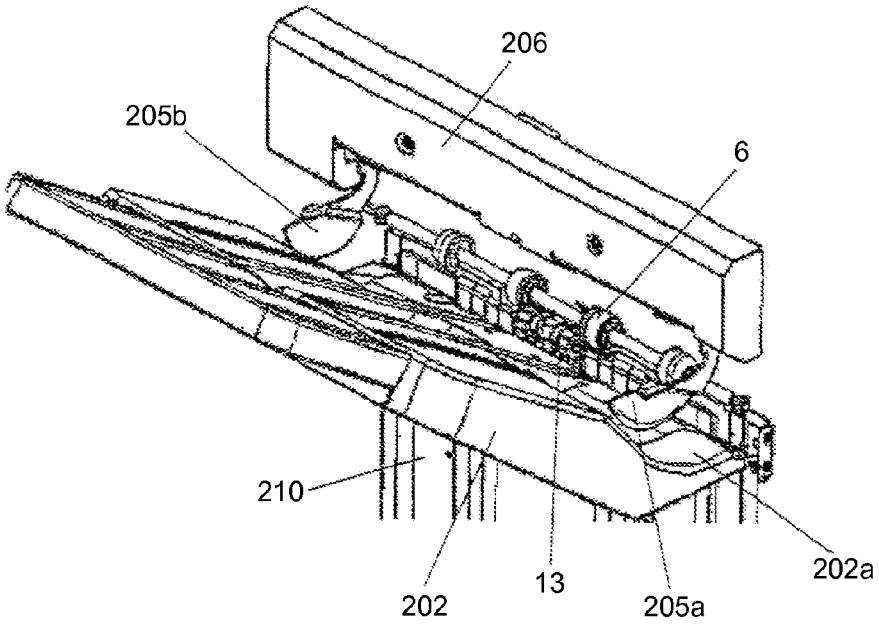
FIG. 7 is a perspective view of a sheet discharging unit including the shift tray and sheet discharging rollers.

FIG. 7 is a perspective view of the sheet discharging unit that includes the shift tray and the sheet discharging rollers. As illustrated in FIG. 7, a pair of joggers 205*a* and 205*b* that aligns the sheet P in the sheet width direction on the shift tray 202 is arranged above the shift tray 202. The joggers 205*a* and 205*b* are movable in the width direction of the sheet P by being driven by a jogger driving mechanism 206. The jogger driving mechanism 206 has a known structure and its mechanism does not have direct bearing on the present invention; accordingly, detailed description about the jogger driving mechanism 206 is omitted. Reference numeral 202*a* in FIG. 5 and other drawings denotes a recess provided to permit the joggers 205*a* and 205*b* to move.

Figure 8:
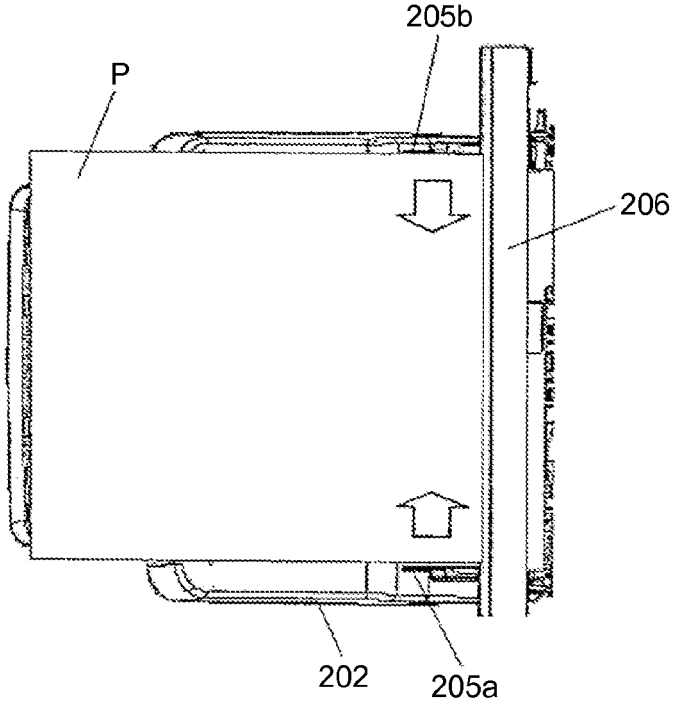
FIG. 8 is a diagram illustrating an alignment operation in a sheet width direction on the shift tray.

FIG. 8 is a diagram illustrating an alignment operation in the sheet width direction on the shift tray 202. The alignment operation is performed after the sheet P is discharged by sandwiching the sheet P between the jogger 205*a* from one side in the sheet width direction and the jogger 205*b* from the other side.

Figure 9:
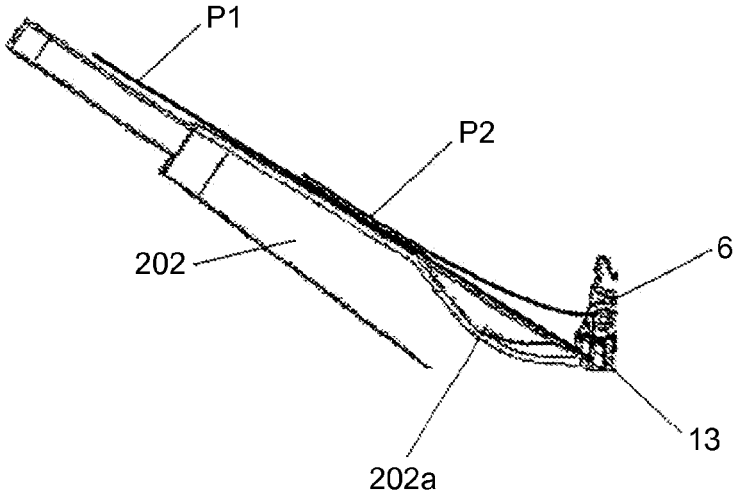
FIG. 9 is a diagram illustrating the shift tray in a state where a subsequent sheet is discharged onto the shift tray where a preceding sheet is placed.
Figure 10:
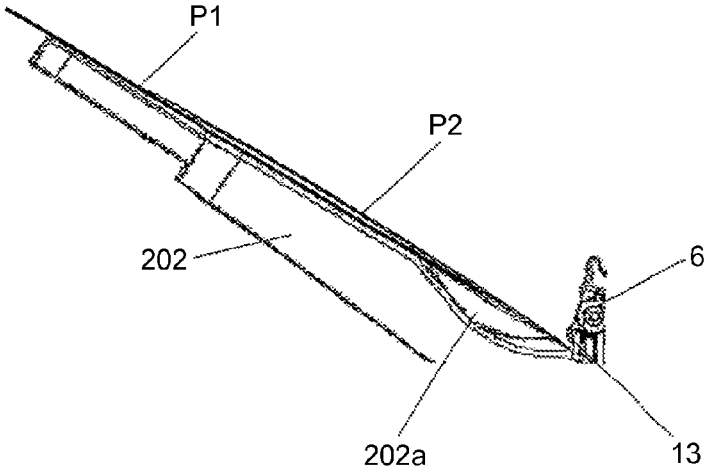
FIG. 10 is a diagram illustrating the shift tray in a state, continued from the state illustrated in FIG. 9, where clinging due to inter-sheet close contact occurs, causing a subsequent sheet to push out a preceding sheet.
Figure 11:
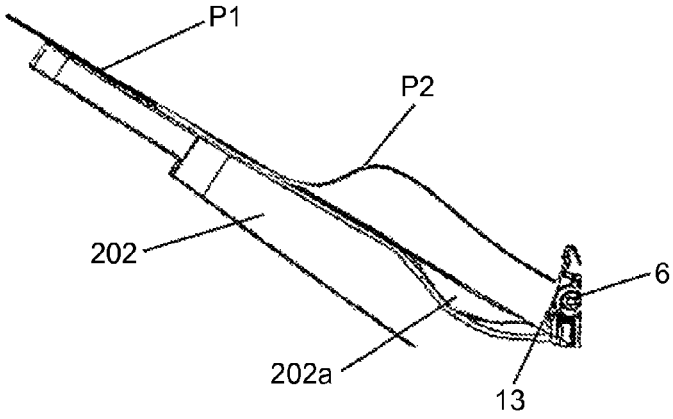
FIG. 11 is a diagram illustrating the shift tray in a state, continued from the state illustrated in FIG. 9, where clinging due to inter-sheet close contact occurs, causing a subsequent sheet to collapse (buckle)

However, a sheet discharge tray having such a configuration can cause the problem described above when the sheet P has high smoothness as does coated paper. For example, when a subsequent sheet P2 is discharged onto the shift tray 202 where a preceding sheet P1 is already placed as illustrated in FIG. 9, sheet clinging due to inter-sheet close contact can occur. Such clinging can result in the following phenomenon: the subsequent sheet P2 that is in contact with the preceding sheet P1 undesirably pushes out the preceding sheet P1 as illustrated in FIG. 10. Or, alternatively, the following phenomenon can occur: close contact between a leading end portion of the subsequent sheet P2 and the preceding sheet P1 prevents further conveyance of the subsequent sheet P2, causing the subsequent sheet P2 to collapse (buckling) as illustrated in FIG. 11. Any one of these phenomena results in defective discharging or defective stacking.

Figure 12:
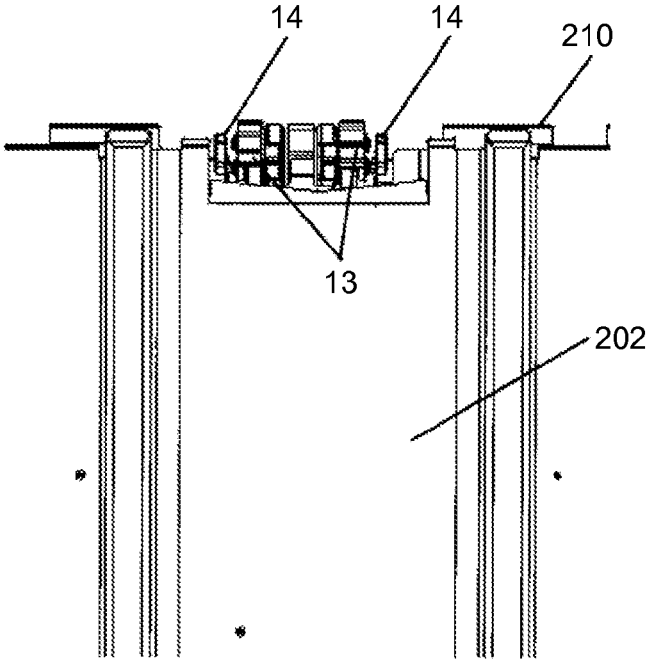
FIG. 12 is a diagram of the sheet discharging device according to the embodiment as viewed in a direction from the shift tray.
Figure 13:
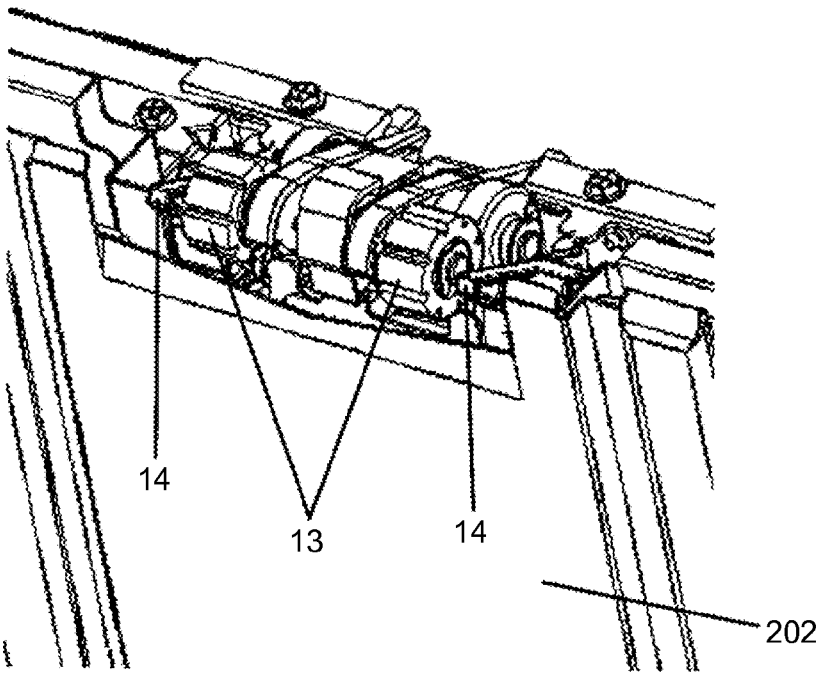
FIG. 13 is a perspective view of the sheet discharging unit illustrated in FIG. 12 as viewed from obliquely above.

Therefore, the configuration of the sheet discharging unit illustrated in FIGS. 5 to 7 is changed to the configuration of the sheet discharging unit illustrated in FIGS. 12 and 13 in the embodiment.

FIG. 12 is a diagram of the sheet discharging unit according to the embodiment as viewed in a direction from the shift tray 202. FIG. 13 is a perspective view of the sheet discharging unit illustrated in FIG. 12 as viewed from obliquely above.

Referring to FIGS. 12 and 13, in the embodiment, a pair of the return rollers 13 is arranged to be symmetric with respect to a conveyance center of the shift tray 202. Pressing members 14 are arranged outside the respective return rollers 13. That is, the pair of return rollers 13 is also arranged to be symmetric with respect to the conveyance center of the shift tray 202.

The pressing members 14 perform a pressing operation only when coated paper is fed. The CPU 101 of the sheet post processing apparatus PD makes determination, which will be described later, as to whether or not a sheet being fed is coated paper based on sheet-type information transmitted from the image forming apparatus PR, and controls the operation.

Figure 14:
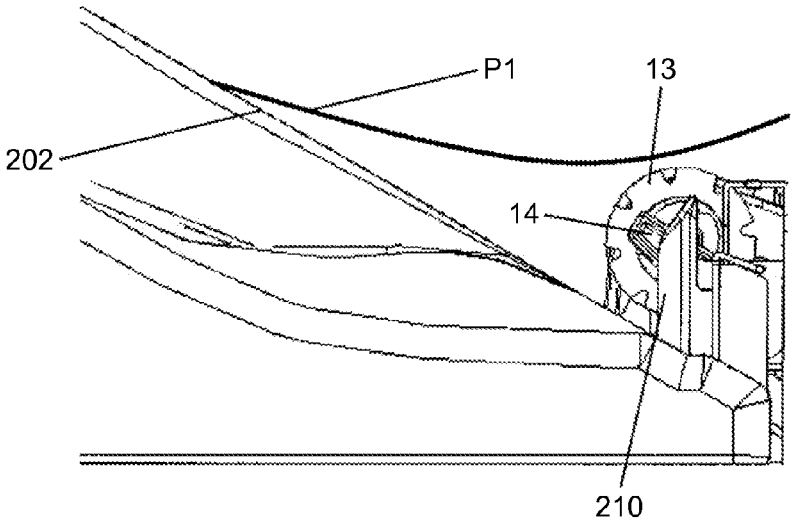
FIG. 14 is an explanatory diagram of an operation of pressing members in a state where the preceding sheet is being discharged onto the shift tray.
Figure 15:
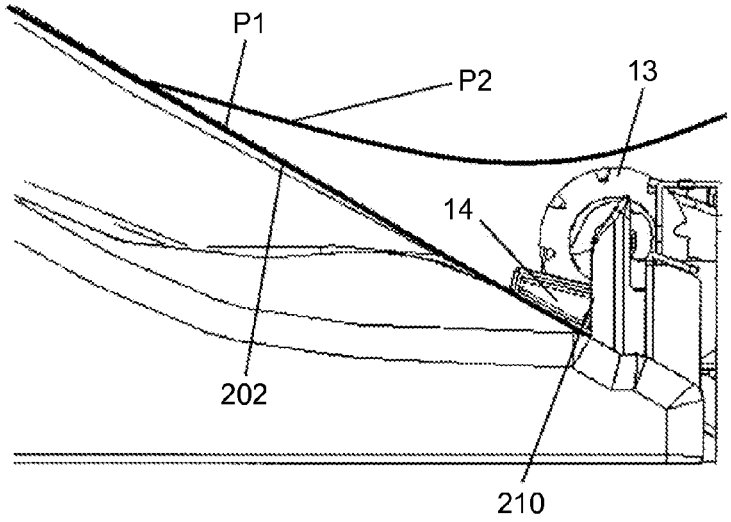
FIG. 15 is an explanatory diagram of the operation of the pressing members in a state where the pressing members press a trailing end of the preceding sheet before the subsequent sheet contacts the preceding sheet.

FIG. 14 and FIG. 15 are explanatory diagrams illustrating outline of operations of the pressing members. FIG. 14 illustrates a state where the preceding sheet P1 is being discharged onto the shift tray 202. When the preceding sheet P1 is discharged onto the shift tray 202 from this state, the return rollers 13 descend and move the preceding sheet P1 on the shift tray 202 back toward the end fence 210. Sheet alignment in the conveying direction is thus performed. Subsequently, the joggers 205*a* and 205*b* perform sheet alignment in the width direction.

After completion of the sheet alignment in the conveying direction and in the width direction, the pressing members 14 press a trailing end of the subsequent sheet P2 as illustrated in FIG. 15 before the subsequent sheet P2 contacts the preceding sheet P1. When the subsequent sheet P2 is discharged and the trailing end of the subsequent sheet P2 passes through the sheet discharging rollers 6, the pressing members 14 withdraw from the preceding sheet P1.

Figure 16:
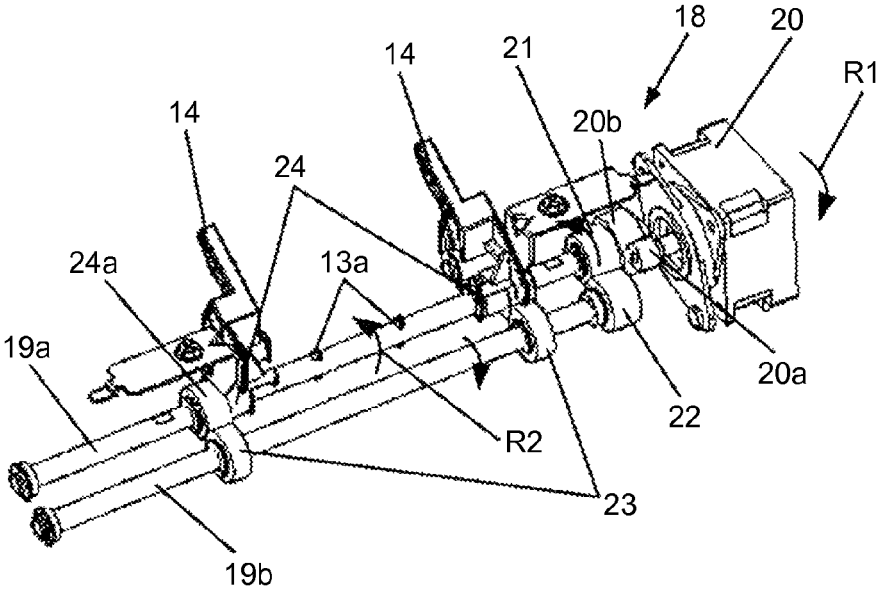
FIG. 16 is a diagram illustrating a drive mechanism of return rollers and the pressing members in a state where the return rollers are operated.
Figure 17:
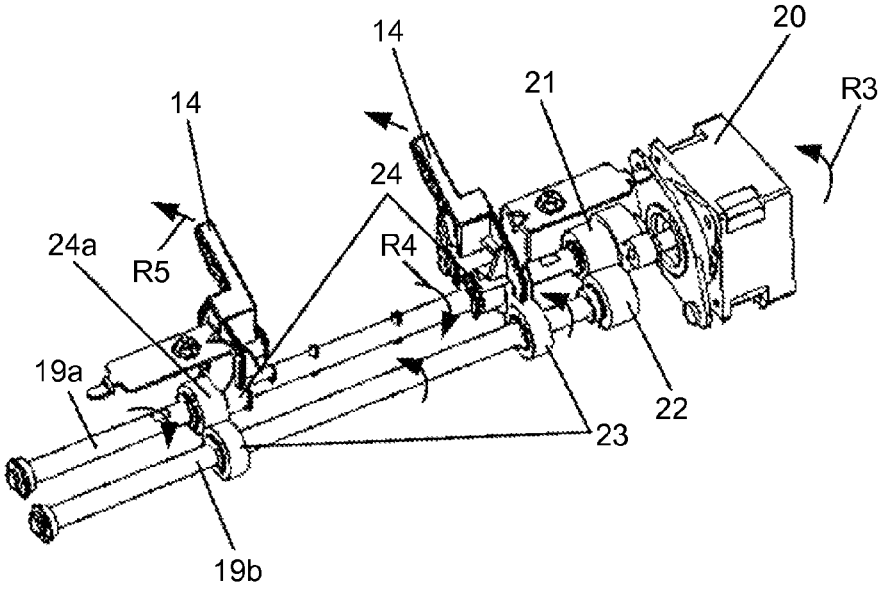
FIG. 17 is a diagram illustrating the drive mechanism of the return rollers and the pressing members in a state where the pressing members are operated.

FIGS. 16 and 17 are diagrams illustrating a drive mechanism of the return rollers and the pressing members. FIG. 16 illustrates a state where the return rollers operate. FIG. 17 illustrates a state where the pressing members operate.

A drive mechanism 18 includes a first shaft 19*a*, a second shaft 19*b*, a return-roller driving motor 20 that drives the first shaft 19*a* to rotate, a drive gear 20*a*, a driven gear 20*b*, first to third gears 21, 22, and 23, and cams 24.

The return-roller driving motor 20 has the drive gear 20*a* on a distal end of a rotating shaft of the motor 20. The drive gear 20*a* can rotate the first shaft 19*a* either forward or in reverse by meshing with the driven gear 20*b* attached to a shaft end of the first shaft 19*a*.

The first gear 21 arranged on the first shaft 19*a* can mesh with the second gear 22 arranged on the second shaft 19*b*, thereby transmitting a driving force of the return-roller driving motor 20 to the second shaft 19*b*. One-way clutches are arranged on the first and second gears 21 and 22. The one-way clutch locks during rotation in respective directions opposite to each other.

A pair of the third gears 23 are arranged to be symmetric with respect to the conveyance center of the sheet P and fixed onto the second shaft 19*b*. Accordingly, the third gears 23 are rotated by rotation of the second shaft 19*b*. The third gears 23 drive the pair of cams 24 by meshing with gear portions of the cams 24 arranged on the first shaft 19*a*. The cams 24 rotate only when the third gears 23 rotate because the cams 24 are not fixed onto the first shaft 19*a*. The pair of pressing members 14 is rotatably supported on a support shaft 14*d*. The pair of cams 24, which are freely-rotatably mounted on the first shaft 19*a*, moves (causes to swing) the respective pressing members 14 between a pressing position and a withdrawn position.

The drive mechanism 18 configured as described above uses the return roller motor 20 as a driving source. The return rollers 13 are fixed onto projections projecting from a circumferential portion of the first shaft 19*a* as illustrated in FIGS. 16 and 17 and rotate in synchronization with the first shaft 19*a*.

FIG. 16 illustrates a state where the return-roller driving motor 20 rotates forward (in the direction indicated by arrow R1). When the return-roller driving motor 20 rotate forward, the first and second gears 21 and 22 rotate, causing the return rollers 13 (the first shaft 19*a*) to rotate in the direction that brings back the sheet (in the direction indicated by arrow R2). However, because the first shaft 19*a* rotates but the second shaft 19*b* stops by virtue of the one-way clutches, the third gears 23 and the cams 24 do not rotate. Accordingly, the pressing members 14 are held in the withdrawn (away) state illustrated in FIG. 14.

When a moving-back operation of the return rollers 13 is completed, the pressing operation is started by rotating the return-roller driving motor 20 in reverse (in a direction indicated by arrow R3) as illustrated in FIG. 17. During the pressing operation of the pressing members 14, the first and second gears 21 and 22 are rotated by the reverse rotation of the return-roller driving motor 20. The first shaft 19*a* stops but the second shaft 19*b* rotates by virtue of the one-way clutches, causing the third gears 23 and the cams 24 to rotate. Accordingly, the third gears 23 rotate in the direction indicated by arrow R3, and the cams 24 rotate in a direction indicated by arrow R4. The pressing members 14 are moved by the cams 24 (in a direction indicated by arrow R5). This operation is the pressing operation of the pressing members 14. The pressing and withdrawing operations of the pressing members are performed along the shape of the cams only when the return-roller driving motor 20 rotates in reverse. The cams 24 are eccentric cams arranged so as to rotate in synchronization with a driven gear 24*a* fixed to the first shaft 19*a*. The cam 24 includes a flat portion at a rotational position corresponding to the withdrawn position (see FIGS. 20 and 21). The third gears 23 mesh with driven gears 24*a*. The driven gears 24*a* are driven to rotate by the third gears 23 that are rotated by rotation of the second shaft 19*b*.

Figure 18:
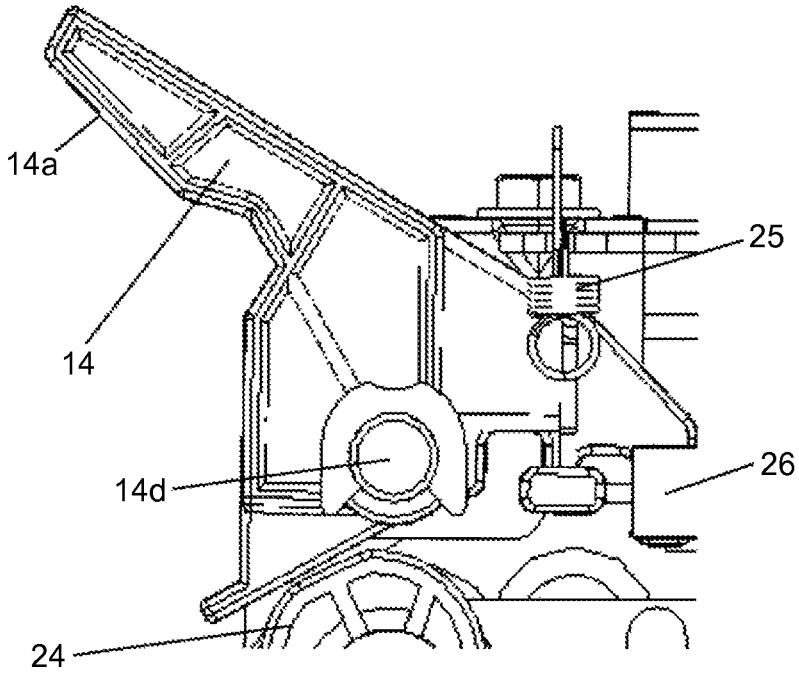
FIG. 18 is a diagram illustrating a configuration of a distal end of the pressing member.

FIG. 18 is a diagram illustrating a configuration of a distal end of the pressing member 14. FIG. 18 is a diagram of the pressing member 14 as viewed from the conveying center toward the back in FIG. 16. The pressing member 14 includes a pressing portion 14*a* having a planar shape at its distal end and presses a sheet placed on the shift tray 202 with the pressing portion 14*a*. In the embodiment, the pressing portion 14*a* is configured to be oriented substantially parallel to the stacking surface of the shift tray 202 when the pressing portion 14*a* presses the sheet P. The pressing portion 14*a* may have a curved geometry or the like in lieu of a flat geometry.

Figure 19:
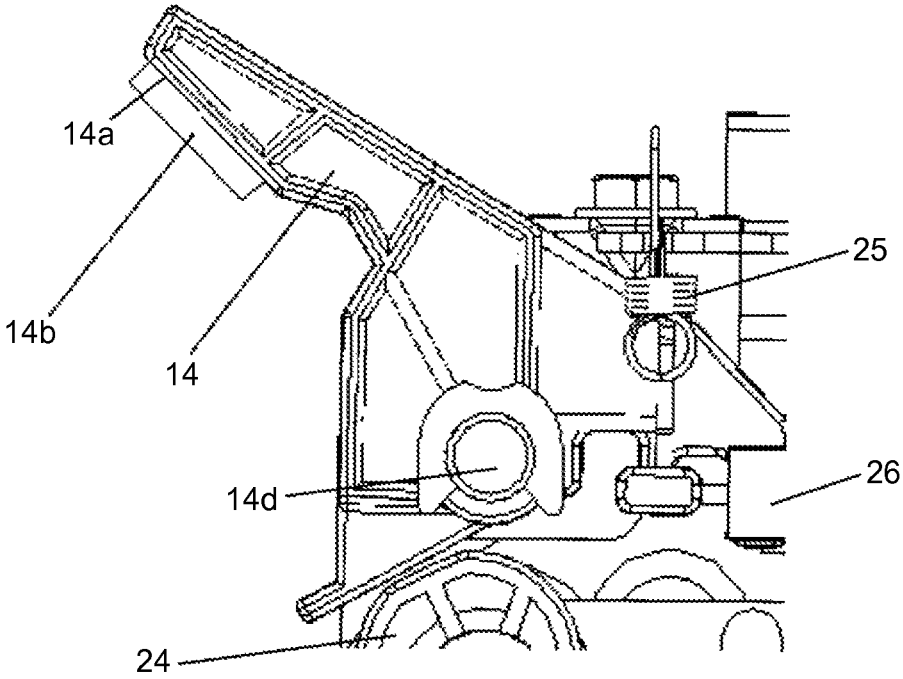
FIG. 19 is a diagram illustrating another configuration example of the distal end of the pressing member.

FIG. 19 is a diagram illustrating another configuration example of the distal end of the pressing member 14. In this configuration example, a cushion material 14*b* is bonded to the pressing portion 14*a*. This configuration allows the pressing portion 14*a* to elastically press the sheet P and adapt to a change in thickness of the sheet P or the sheet bundle PB only with the cushion material 14*b*.

Figure 20:
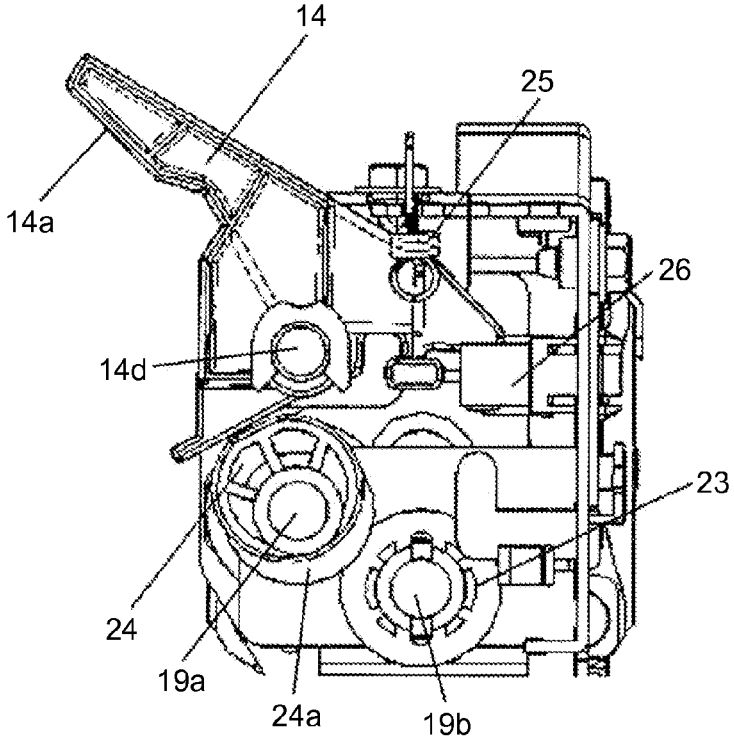
FIG. 20 is a diagram illustrating the pressing member in a withdrawn state.
Figure 21:
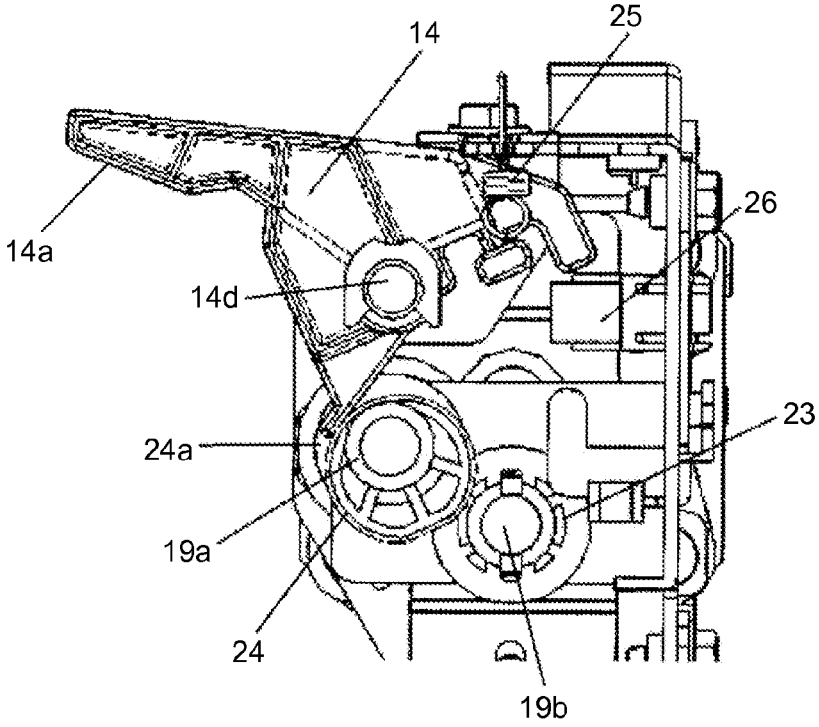
FIG. 21 is a diagram illustrating the pressing member in a state of performing a pressing operation.

FIG. 20 illustrates the pressing member is in the withdrawn state. FIG. 21 illustrates the pressing member in a state of performing the pressing operation. FIGS. 20 and 21 are diagrams of the pressing member as viewed from the conveying center toward the back in FIG. 16. As illustrated in FIGS. 20 and 21, springs 25 serving as elastic members constantly apply an elastic force to the pressing members 14 in a withdrawing direction. Accordingly, the pressing members 14 operate in the direction of pressing the sheet P only when the pressing members 14 are pushed out by rotation of the cams 24. The pressing member 14 has a filler shape 14*c*. A transmission type sensor 26 detects a home position of the pressing member 14 by detecting the filler shape 14*c*. In the embodiment, the home position is the position illustrated in FIG. 20 where the pressing member 14 is in the withdrawn state.

The drive mechanism configured as described above allows obtaining favorable alignment accuracy. This is because the preceding sheet P1 clinging due to inter-sheet close contact is pressed in a state where the preceding sheet P1 has been moved back by the return rollers 13. Furthermore, reduction in size and cost can be achieved because the return rollers 13 and the pressing members 14 are driven by the same single driving source. Switching between the moving-back operation of the return rollers 13 and the pressing operation of the pressing members 14 can be performed only by switching the rotating direction of the return-roller driving motor 20 between forward and reverse.

Figure 22:
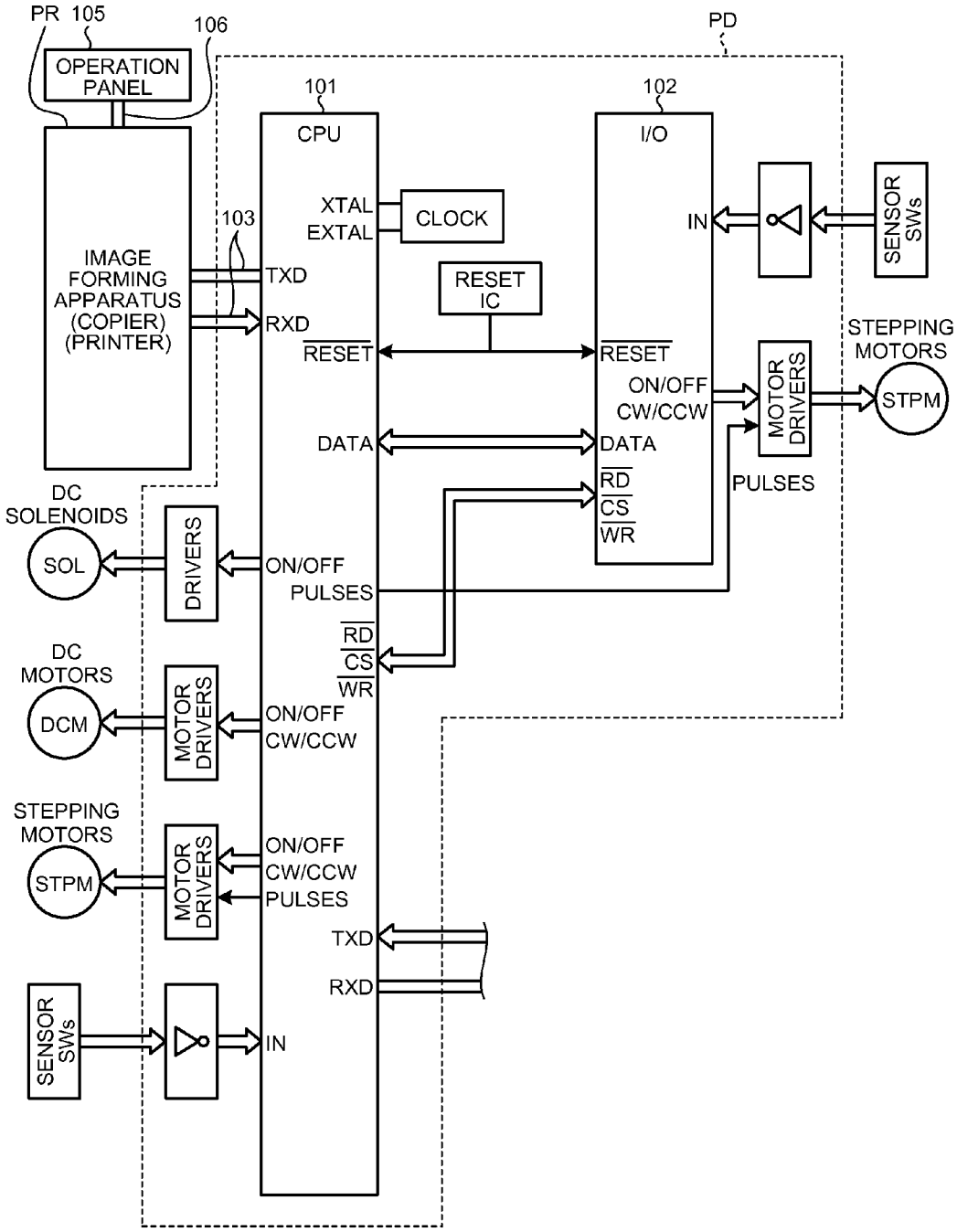
FIG. 22 is a block diagram illustrating a control structure of the image forming system including the sheet post processing apparatus and the image forming apparatus.

FIG. 22 is a block diagram illustrating a control structure of the image forming system including the sheet post processing apparatus and the image forming apparatus. The sheet post processing apparatus PD includes a control circuit, on which a microcomputer including the CPU 101 and an I/O interface 102 is mounted. Signals are input to the CPU 101 from a CPU, or switches and the like of an operation panel 105, and sensors (not shown) of the image forming apparatus PR via a communication interface 103. The CPU 101 executes predetermined control according to the input signal. Moreover, the CPU 101 controls and drives solenoids and motors via drivers and motor drivers, and acquires sensor information from sensors in the post processing apparatus via an interface. Moreover, the CPU 101 controls and drives motors using motor drivers via the I/O interface 102 according to an entity to be controlled and a sensor, and acquires sensor information from the sensor.

The above-described control is executed in accordance with program defined by program codes stored in a ROM (not shown). The CPU 101 reads out the program codes and loads them into a RAM (not shown), and executes the program defined by the program codes while using the RAM as a working area and a data buffer.

Figure 23:
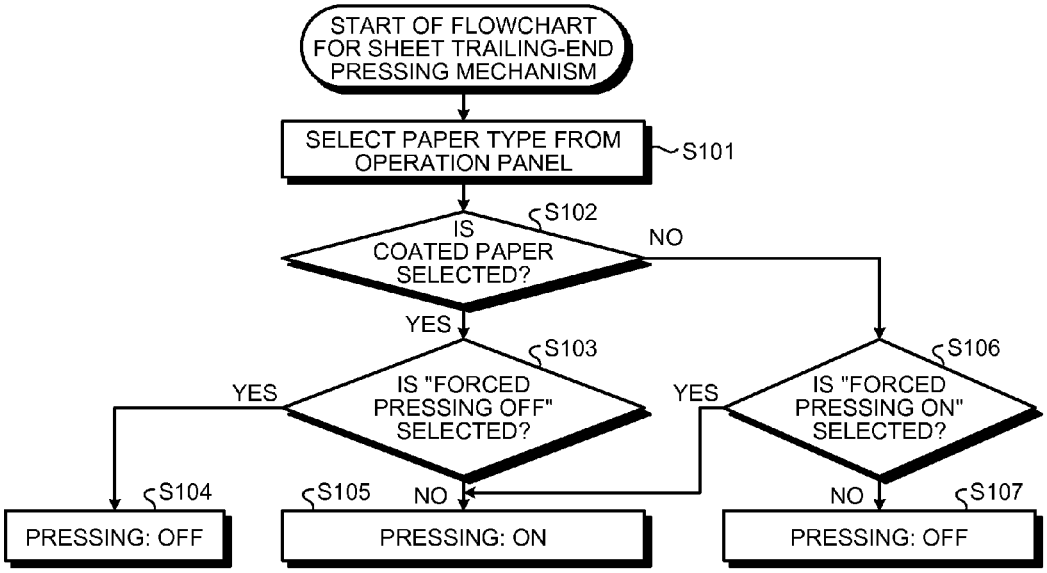
FIG. 23 is a flowchart of a procedure for a trailing-end pressing operation according to the embodiment.
Figure 24:
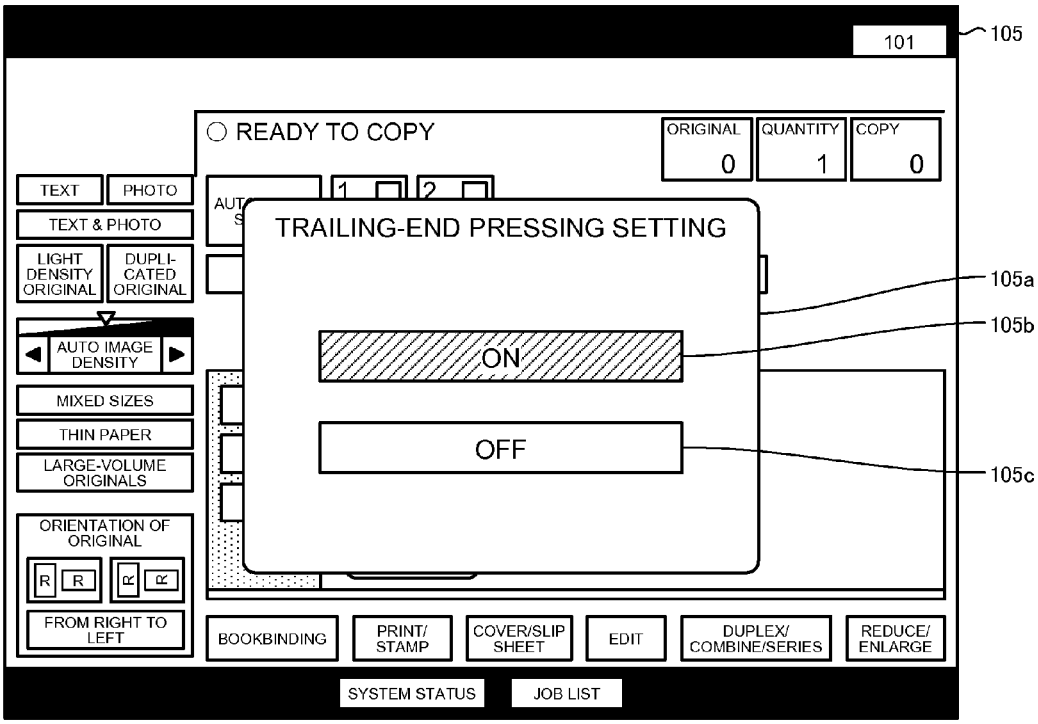
FIG. 24 is a diagram illustrating a selection screen displayed on an operation panel for a trailing-end-pressing setting process.

FIG. 23 is a flowchart of a procedure for a trailing-end pressing operation according to the embodiment. FIG. 24 is a diagram illustrating a selection screen displayed on the operation panel for a trailing-end-pressing setting process. The procedure illustrated in the flowchart is performed by the CPU 101 of the sheet post processing apparatus PD.

The trailing-end-pressing setting process is performed in the following manner. When an "ON" option 105*b* is selected from a configuration screen 105*a* for the trailing-end-pressing setting process on the operation panel 105 illustrated in FIG. 24, the trailing-end pressing is started to be used. When the trailing-end pressing is started to be used, an operation screen on the operation panel 105 changes to a paper-type selection screen (not shown). Although not illustrated, paper-type selector buttons are displayed on this selection screen. A paper type is selected from the selection screen (Step S101). If coated paper is selected (YES in Step S102), the screen changes to a forced-pressing-OFF selection screen.

More specifically, at default settings, when coated paper is selected, the pressing using the pressing members 14 is set to "ON". Accordingly, whether or not "forced pressing (using the pressing members 14) OFF" is selected is determined before the pressing is set to "ON" (Step S103). If "forced pressing OFF" is selected (YES in Step S103), the pressing operation using the pressing members 14 is set to "OFF" (Step S104). Then this routine ends.

If "forced pressing OFF" is not selected (NO in Step S103), the pressing operation using the pressing members 14 is set to "ON" (the return-roller driving motor 20 is to be rotated in reverse; Step S105) to cause a sheet to be pressed and held. Then this routine ends.

When a paper type other than coated paper is selected, the pressing operation is set to "OFF" at the default settings. Accordingly, whether or not "forced pressing ON" is selected is determined (Step S106). If "forced pressing ON" is selected (YES in Step S106), the return-roller driving motor 20 is rotated in reverse (Step S105). If "forced pressing ON" is not selected (NO in Step S106), this routine ends while setting the pressing members 14 to be left in the withdrawn state (Step S107).

When a "NO" option 105*c* is selected on an air-blowing-mode screen, a normal sheet discharging operation is to be performed without performing the pressing operation.

As described above, in the embodiment, when a user selects paper-type information from the operation panel 105, the pressing operation is set to "ON" at the default settings. However, it is possible to cause the pressing operation not to be performed by selecting "forced pressing OFF". At the default settings, the pressing operation is not performed when ordinary paper is selected. However, it is possible to cause the pressing operation to be performed on ordinary paper by selecting "forced pressing ON".

As described above, the embodiment provides the following advantages.

1) The sheet stacking device includes: the shift tray 202 (stacking unit) that stacks thereon a sheet discharged in the sheet discharging direction; the return rollers 13 (conveying unit) that perform the moving-back operation of conveying the stacked sheet P in the direction opposite to the sheet discharging direction; the pressing members 14 (pressing unit) that drives the return rollers 13 and the pressing members 14 by the return-roller driving motor 20 (the same single driving source). Accordingly, the sheet stacking device can press the preceding sheet P1 with the pressing members 14 when the subsequent sheet P2 is discharged, and move back the subsequent sheet with the return rollers 13 by using the single driving source. The pressing operation can prevent the sheet from being pushed out due to electrostatic inter-sheet clinging. As a result, favorable alignment accuracy can be obtained. Furthermore, because the return rollers 13 and the pressing members 14 are driven by the single driving source, the device is not increased in size, and can be provided as a compact device.

2) The driving unit includes the first and second gears 21 and 22 and the one-way clutches (switching unit) that switch between operation of the return rollers 13 and operation of the pressing members 14 in response to a rotating direction of the return-roller driving motor 20. Accordingly, switching between the operations can be performed with a simple configuration.

3) The pressing unit includes the pressing members 14 that are driven by the cams 24 attached to the first shaft 19*a*, the second gear 22 attached to the second shaft 19*b* that drives the cams 24, and the first gear 21 that transmits rotation of the first shaft 19*a* to the second shaft 19*b*. The conveying unit includes the return rollers 13 that are attached to the first shaft 19*a* and rotates in synchronization with the first shaft 19*a*. Accordingly, the effect provided by 1) can be obtained with a simple configuration.

4) The switching unit includes the one-way clutches for the first gear 21 and the second gear 22 that lock during rotation in respective directions opposite to each other. Accordingly, the effect provided by 2) can be obtained with a simple configuration.

5) The pressing members 14 are pivotably supported on the support shaft 14*d*. Rotation of the cams 24 in one rotational direction moves the pressing members 14 between the pressing position (the position in FIG. 20) and the withdrawn position (the position in FIG. 21). Accordingly, the operation of pressing the sheet and the operation of withdrawing from the pressing position can be performed by driving the cams 24. Therefore, the effect provided by 2) can be obtained with a simple configuration.

6) The sheet stacking device includes the CPU 101 (control unit) that controls driving of the return-roller driving motor 20. The CPU 101 causes the pressing members to operate based on paper-type information about the sheet to be discharged (FIG. 23). Accordingly, it becomes possible to perform the pressing operation according to the paper type and prevent the sheet from being pushed out due to electrostatic inter-sheet clinging. As a result, favorable alignment accuracy can be obtained.

7) The pressing members 14 start the pressing operation when the preceding sheet P1 is discharged and the moving-back operation of the return rollers 13 is completed, and withdraw before the trailing end of the subsequent sheet P2 is discharged. Accordingly, the sheet is prevented from being pushed out due to electrostatic inter-sheet clinging. As a result, favorable alignment accuracy can be obtained.

8) A user can configure setting as to whether or not to perform the pressing operation of the pressing members 14 from the operation panel 105 (operating unit). Accordingly, whether or not to perform the pressing operation on the sheet P can be controlled as desired by the user (FIGS. 23 and 24).

The shift tray 202 is an example of "stacking unit" in the appended claims; the return rollers 13 are an example of "conveying unit"; the pressing members 14 are an example of "pressing unit"; the sheet post processing apparatus PD is an example of "sheet stacking device"; the return-roller driving motor 20 is an example of "driving source"; the first and second shafts 19*a* and 19*b*, the first to third gears 21, 22, and 23, the cams 24, and the one-way clutches are an example of "driving unit"; reference numeral 14*d* denotes "support shaft"; the CPU 101 is an example of "control unit"; the operation panel 105 is an example of "operation unit"; reference symbol P denotes "sheet"; reference symbol P1 denotes "preceding sheet"; reference symbol P2 denotes "subsequent sheet"; the system including the image forming apparatus PR and the image post processing apparatus PD is an example of "image forming system".

According to the embodiment, it is possible to prevent a sheet from being pushed out by another sheet and/or misaligned due to electrostatic inter-sheet clinging using a compact device.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet stacking device comprising:

a stacking unit to stack thereon a sheet discharged in a sheet discharging direction;

a conveying unit to perform a moving-back operation of conveying the stacked sheet in a direction opposite to the sheet discharging direction;

a pressing unit to perform a pressing operation of pressing the conveyed sheet, the pressing unit including a pressing member, drivable by a cam attached to a first shaft, a second gear, attached to a second shaft configured to drive the cam, and a first gear to transmit rotation of the first shaft to the second shaft, wherein the conveying unit includes a return roller, attached to the first shaft, to rotate in synchronization with the first shaft; and a driving unit to drive the conveying unit and the pressing unit by a same driving source, the driving unit including a switching unit to switch between operation of the conveying unit and operation of the pressing unit in response to a rotating direction of the driving source.

2. The sheet stacking device of claim 1, wherein the switching unit includes one-way clutches for the first gear and the second gear, to lock during rotation in respective directions opposite to each other.

3. The sheet stacking device of claim 1, wherein the pressing member is pivotably supported on a support shaft, and rotation of the cam in one rotational direction moves the pressing member between a pressing position and a withdrawn position.

4. The sheet stacking device of claim 1, further comprising a control unit to control driving of the driving source, wherein the control unit is configured to cause the pressing member to operate based on paper-type information about the sheet to be discharged.

5. The sheet stacking device of claim 1, wherein when a preceding sheet is discharged and the moving-back operation of the return roller is completed, the pressing member is configured to start the pressing operation, and the pressing member is configured to withdraw before a trailing end of a subsequent sheet is discharged.

6. The sheet stacking device of claim 1, further comprising an operating unit to allow a user to configure setting as to whether or not to perform operation of the pressing member.

7. An image forming system comprising:

a sheet stacking device, the sheet stacking device including a stacking unit to stack thereon a sheet discharged in a sheet discharging direction;

a conveying unit to perform a moving-back operation of conveying the stacked sheet in a direction opposite to the sheet discharging direction;

a pressing unit to perform a pressing operation of pressing the conveyed sheet, the pressing unit including a pressing member, drivable by a cam attached to a first shaft, a second gear, attached to a second shaft configured to drive the cam, and a first gear to transmit rotation of the first shaft to the second shaft, wherein the conveying unit includes a return roller, attached to the first shaft, to rotate in synchronization with the first shaft; and a driving unit to drive the conveying unit and the pressing unit by a same driving source, the driving unit including a switching unit to switch between operation of the conveying unit and operation of the pressing unit in response to a rotating direction of the driving source.

8. A sheet stacking method comprising:

stacking a sheet discharged in a sheet discharging direction on a stacking unit;

performing, by a conveying unit, a moving-back operation of conveying the stacked sheet in a direction opposite to the sheet discharging direction; and performing, by a pressing unit, a pressing operation of pressing the conveyed sheet, wherein the pressing unit includes a pressing member, drivable by a cam attached to a first shaft, a second gear, attached to a second shaft configured to drive the cam, and a first gear to transmit rotation of the first shaft to the second shaft, wherein the conveying unit includes a return roller, attached to the first shaft, to rotate in synchronization with the first shaft, the conveying unit and the pressing unit are driven by a same driving source, switching between operation of the conveying unit and operation of the pressing unit is performed in response to a rotating direction of the driving source, after a preceding sheet is discharged and the moving-back operation is completed, the pressing operation is started, and the pressing unit withdraws from a pressing position before a trailing end of a subsequent sheet is discharged.

* * * * *